US005492159A

United States Patent [19]

Maloshicky

[11] Patent Number: 5,492,159

[45] Date of Patent: Feb. 20, 1996

[54] LOG-CUTTER SPLITTER

[76] Inventor: Henry Maloshicky, 545 Alfred Avenue, Winnipeg, Manitoba, Canada, R2W 1Y5

[21] Appl. No.: 368,344

[22] Filed: Jan. 4, 1995

[51] Int. Cl.[6] ..... B27L 7/00; B27C 1/00

[52] U.S. Cl. ..... 144/193 A; 144/167 R; 144/193 R; 144/366; 144/193 D

[58] Field of Search ..... 144/3 K, 162 R, 144/193 R, 193 A, 193 D, 366

[56] References Cited

U.S. PATENT DOCUMENTS

| | | | |
|---|---|---|---|
| 4,079,591 | 3/1978 | Syrjala et al. | 144/193 R |
| 4,378,036 | 3/1983 | Williams | 144/366 |
| 4,751,949 | 6/1988 | Berner | 144/193 A |
| 5,029,625 | 7/1991 | Diemer | 144/193 R |

FOREIGN PATENT DOCUMENTS

| | | | |
|---|---|---|---|
| 982032 | 2/1974 | Canada | 144/193 D |
| 105547 | 9/1942 | Sweden | 144/193 D |

*Primary Examiner*—W. Donald Bray
*Attorney, Agent, or Firm*—Adrian D. Battison; Murray E. Thrift

[57] ABSTRACT

The present invention relates to a log cutter-splitter device which cuts and splits logs into two or more pieces in one pass of the cutting mechanism. The cutter-splitter includes a wedge and a primary splitting blade for splitting a log along its length, and a cutting blade for cutting across the width. Each is arranged in a vertical plane and positioned for engaging the log from above. The log is supported upon a cradle and the wedge and blades are driven downwards into the log by driving means.

17 Claims, 2 Drawing Sheets

LOG-CUTTER SPLITTER

FIELD OF THE INVENTION

The present invention relates to a log cutter-splitter device which cuts and splits logs into two or more pieces in one pass of the cutting mechanism.

BACKGROUND OF THE INVENTION

The effort required to cut and split wooden logs for firewood has resulted in the invention of various labour saving devices.

Various wedge type devices for driving into a log either end on or from the side have been developed. These devices require less precision than splitting the log with an axe and therefore require somewhat less effort due to a reduction in the number of blows required to split the log. These devices usually require that the logs be precut into sections of a relatively fixed length before splitting.

One type of device which performs both the task of cutting and splitting a log, first cuts a length off the end of a log and then forces the log, end on, onto a wedge which splits the log length wise. The end on splitting technique tends to mash the end of the log section which is forced onto the splitting member and does not always completely separate the split sections. The split sections must then be separated by the operator. This type of device also operates on a two step process which is relatively slow.

A log cutter-splitter device is therefore needed which cuts and splits the log in a single step without mashing or otherwise damaging the split sections and which completely separates the split sections during operation.

SUMMARY OF THE INVENTION

It is one aspect of the current invention, therefore, to provide a log cutter-splitter which cuts and splits the log in a single step without mashing or otherwise damaging the split sections and which completely separates the split sections during operation.

According to the present invention there is provided a log cutter-splitter for cutting and splitting logs, comprising: a wedge for splitting a log along its length positioned for engaging the log from above, having a wide top end, and tapering to a point at a bottom end; a primary splitting blade arranged in a vertical plane for cutting the log along its length, being positioned for engaging the log from above, and having a cutting edge at a bottom end; a cutting blade arranged in a vertical plane for cutting across the width of the log, being positioned for engaging the log from above, and having a cutting edge at a bottom end; supporting means for supporting the log positioned below the wedge, primary splitting blade, and cutting blade; driving means for driving the wedge, the primary splitting blade and the cutting blade into the log; mounting means for mounting the wedge such that the point of the wedge lies below the cutting edge of the primary splitting blade, and for mounting the primary splitting blade and cutting blade such that the cutting edge of the primary splitting blade lies below the cutting edge of the cutting blade; and wherein the cutting blade is arranged substantially perpendicular to the primary splitting blade.

Preferably the support means comprise a cradle having a forward edge and a rearward edge such that the log is moved in a direction from the rearward edge towards the forward edge.

Preferably the wedge, the splitting blade, and the cutting blade are located near the forward edge of the supporting means with the wedge and cutting blade located at opposing ends of the primary splitting blade and the point of the wedge and the cutting edge of the primary splitting blade positioned colinearly with respect to each other and wherein the wedge is wider than the bottom end of the primary splitting blade.

Preferably the cutting edge of the primary splitting blade and cutting blade is V shaped in cross section.

Preferably there are a pair of secondary splitting blades arranged in a vertical plane for cutting the log along its length, positioned for engaging log sections from above, and having a cutting edge at a bottom end being mounted on mounting means such that the cutting edge of the pair of secondary splitting blades lies above the cutting edges of both the primary splitting blade and the cutting blade.

Preferably the pair of secondary splitting blades is driven into the log by the driving means.

Preferably each blade of the pair of secondary splitting blades is positioned on a respective side of the primary splitting blade for engaging sections of the log having been split by the primary splitting blade thereby further splitting them into smaller sections, and are arranged parallel to one another and the primary splitting blade, and perpendicular to the cutting blade.

Preferably the cutting edge of each blade of the pair of secondary splitting blades is angled from a side surface of said each blade located furthest from the primary splitting blade downwards to a side surface of said each blade located nearest the primary splitting blade.

Preferably the pair of secondary splitting blades are located between the wedge and cutting blade.

One embodiment of the invention will now be described in conjunction with the accompanying drawings in which:

DESCRIPTION OF THE DRAWINGS.

In the drawings like characters of reference indicate corresponding parts in the different figures.

DETAILED DESCRIPTION

Figures 1, 4:
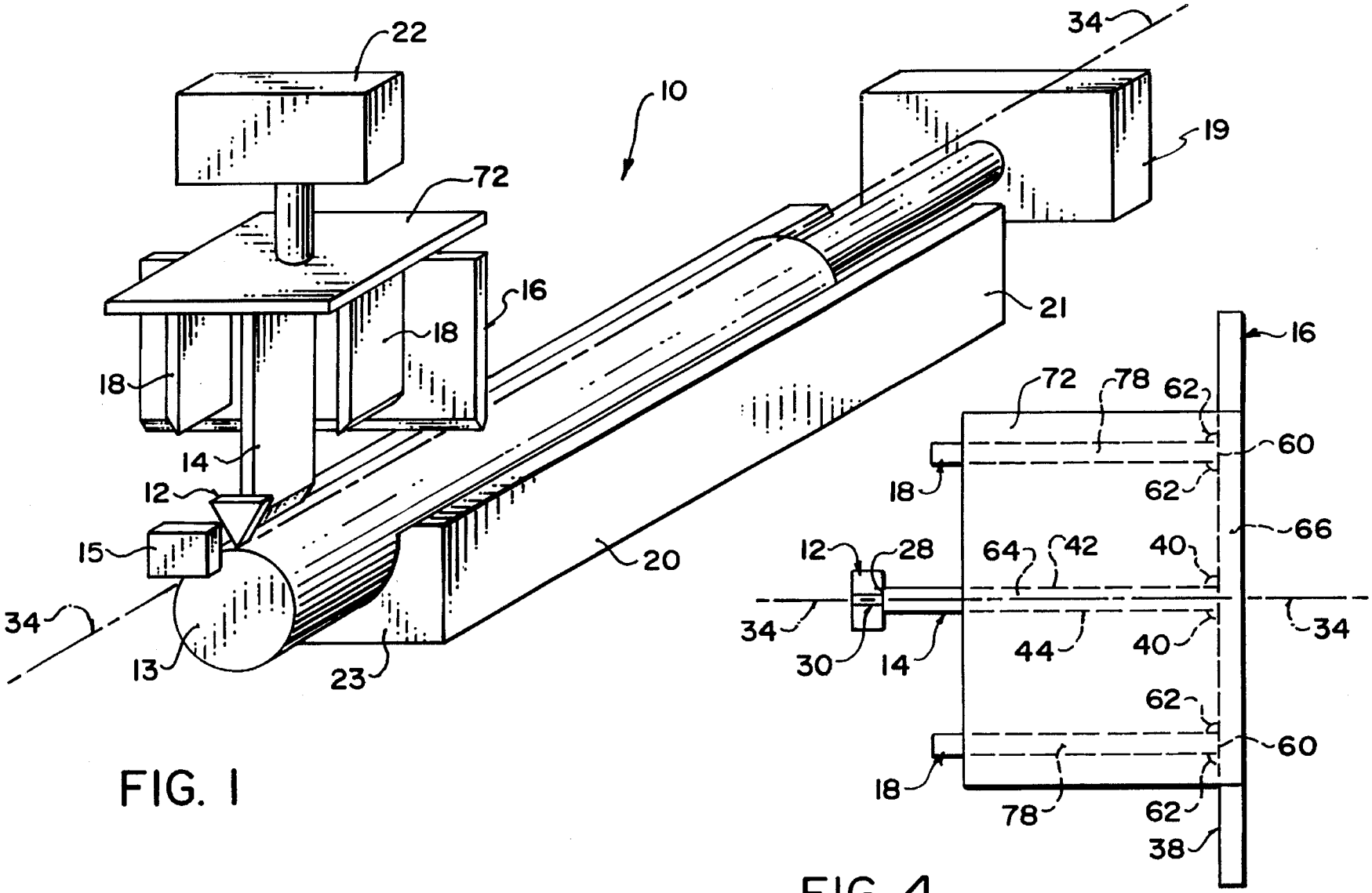
FIG. 1 is an isometric view of the cutter-splitter.
FIG. 4 is a top view of the cutter-splitter blades and wedge.
Figure 3:
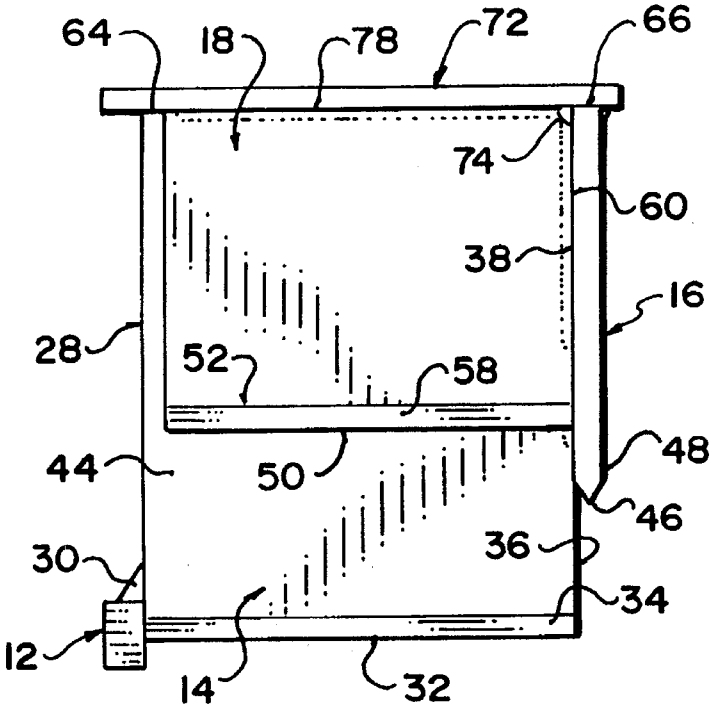
FIG. 3 is a side view of the cutter-splitter blades and wedge.
Figure 2:
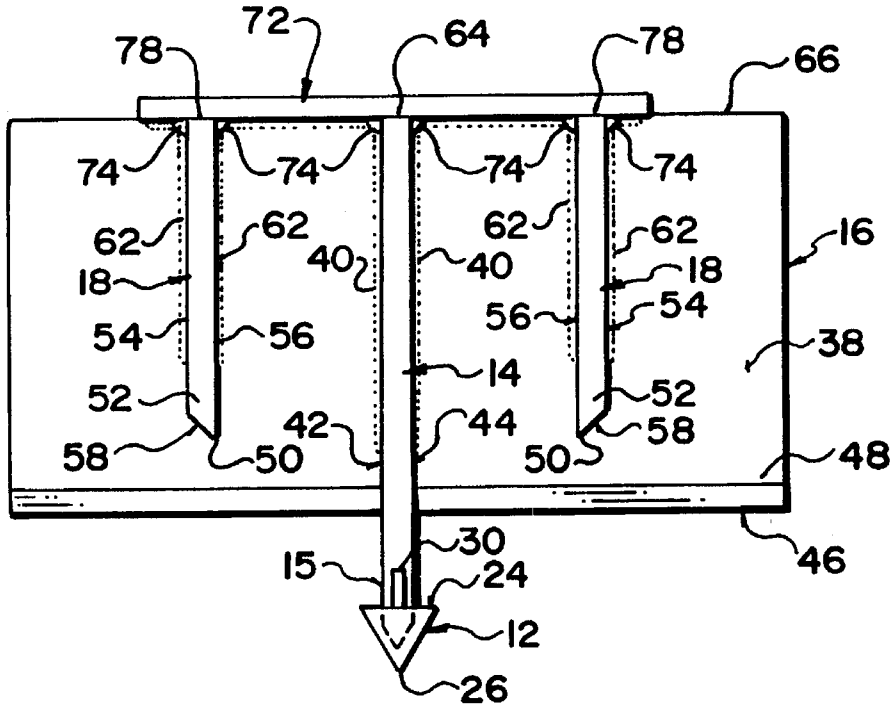
FIG. 2 is a front view of the cutter-splitter blades and wedge.

Referring to FIG. 1 a preferred embodiment of the cutter-splitter is shown generally at 10. The cutter-splitter 10 includes a wedge 12, a primary splitting blade 14, a cutting blade 16, and a pair of secondary splitting blades 18, for cutting and splitting a log 13. The wedge 12 and blades 14, 16, and 18 are positioned over a cradle 20 near the front end 23. The cradle supports the log 13 during operation of the device and allows the log 13 to be moved by feeding means 19 along its length from a rear end 21 of the cradle 20 to a front end 23 of the cradle 20. The wedge 12 and blades 14, 16, and 18 are driven into the logs by driving means 22.

Referring to FIGS. 1 to 4 the wedge 12 is positioned above the cradle 20, has a wide top end 24 and tapers downwards to a point 26 at its bottom such that the width of the wedge is wider that the bottom 15 of the primary splitting blade 14. The wedge 12 is mounted on the front surface 28 of the primary splitting blade 14 by means of an angled bracket 30 which is welded to the front surface 28 of the primary splitting blade 14 and to the top end 24 of the wedge 12.

The primary splitting blade 14 is also positioned above the cradle 20 and is arranged in a vertical plane so that it will cut the log 13 along its length when driven into the log 13 from above by the driving means 22. The primary splitting blade 14 has a V shaped cutting edge 32 which runs along the length of the bottom 34 of the blade 14. The point of the wedge 12 and the cutting edge 32 of the blade 14 are collinear and lie along a longitudinal centre line 34 of the cradle 20. The primary splitting blade 14 is mounted at its back end 36 on the front surface 38 of the cutting blade 16 by means of two welds 40 one on each respective side 42 and 44 of the primary splitting blade 14 such that the primary splitting blade 14 lies perpendicular relative to the cutting blade 16

The cutting blade 16 is also positioned above the cradle 20 and is arranged in a vertical plane so that it will cut the log 13 across its width when driven into the log 13 from above by the driving means 22. The cutting blade 16 has a V shaped cutting edge 46 which runs along the length of the bottom 48 of the blade 16. The cutting blade 16 lies perpendicular relative to the longitudinal axis of the log 13 so that when it engages the log 13 across its width it cuts a section off the front end of the log.

The secondary splitting blades 18 are positioned above the cradle 20 and arranged in a vertical plane so that they will cut sections of the log 13 along their lengths when driven into the log 13 sections from above by the driving means 22. Each one of the two secondary splitting blades 18 is positioned on a respective side 42 and 44 of the primary splitting blade 14 for engaging sections of the log 13 having been split by the primary splitting blade 14 thereby further splitting them into smaller sections. Each secondary splitting blade 18 has a cutting edge 50 which runs along the length of the bottom 52 of each blade 18. The cutting edge 50 is angled from a side surface 54 of the blade located furthest from the primary splitting blade 14 downwards to a side surface 56 of the blade located nearest the primary splitting blade 14. The angled cutting edge 50 creates an angled face 58 which faces downwards and away from the primary splitting blade 14. Each secondary splitting blade 14 is mounted at its back end 60 on the front surface 38 of the cutting blade 16 by means of two welds 62 one on each respective side 54 and 56 of the secondary splitting blade 18 such that each secondary splitting blade 18 lies perpendicular relative to the cutting blade 16 and parallel to the primary splitting blade 14.

Primary splitting blade 14, the cutting blade 16, and secondary cutting blades 18 are mounted at their respective top ends 64, 66, 68, and 70 to a plate 72 by means of welds 74. The plate 72 is fixed to the drive means 22 which is a hydraulic cylinder in the preferred embodiment. The hydraulic cylinder drives the blades downwards into the log and then returns them to the raised position to receive another portion of the log 13.

The wedge 12 and blades 14, 16 and 18 are mounted with the point of the wedge 26 and the cutting edges of the blades 32, 46, and 50 oriented such that the point of the wedge 26 lies below the cutting edge 32 of the primary splitting blade 14, and the cutting edge 32 of the primary splitting blade 14 lies below the cutting edge 46 of the cutting blade 16. The cutting edges 50 of the two secondary splitting blades 18 lie above the cutting edges 32 and 46 of both the primary splitting blade 14 and the cutting blade 16 and lie one on each respective side of the primary splitting blade 14. The wedge 12 and cutting blade 16 are located at opposing ends of the primary splitting blade 14.

In use a log 13 is placed on the cradle 20 in front of the feeding means 19 and is fed along the cradle 20 until the front end of the log 13 contacts a limit switch 15. The switch 15 then causes the feeding means 19 to stop moving the log 13. The switch 15 is positioned to stop the log 13 under the cutter-splitter 10 with the desired length of log extending past the cutting blade 16 of the cutter-splitter 10. The driving means 22 then move the wedge 12 and blades 14, 16, and 18 downwards into contact with the log 13. The point of the wedge 26 contacts the top of the log 13 first and is forced into the log near the front end of the log by the driving means 22. As the wedge 12 is forced into the front of the log 13 it begins to split the log along its length and applies a torque to the sections of the log 13 such that the top of the log 13 is displaced outwards. The primary splitting blade 14 which is thinner than the wedge 12 follows the wedge 12 into the log 13 as the log is being split thus further separating any portions of the two sections of the log which may still be connected to one another. The cutting blade 16 follows the primary splitting blade 14 cutting the log 13 across its width as it is being split. The torque applied by the wedge 12 to the two sections of the log 13 as it splits them causes the top of the sections to rotate outwards as the cutting blade 16 passes through the log from above. As the two sections of the log rotate outwards one blade of the secondary splitting blades 18 engages each respective section of log 13 and splits it further into two additional pieces. Additional pairs of secondary blades may be employed to split the log into smaller sections. The outwards facing surfaces 58 on the secondary splitting blades 18 cause the log sections to move outwards away from the primary blade 14 thereby reducing the risk of binding in the machine.

After splitting, the log no longer contacts the limit switch 15 thereby causing the feeding means 19 to feed the next portion of the log 13 forward into position for cutting and splitting.

In an alternative arrangement (not shown) there is provided a second set of secondary splitters which are arranged as a pair outside the secondary splitting blades 18 with each being spaced equi-distantly out from the blade 18 and each having a lower cutting edge spaced upwardly from the cutting edge of the blade 18. Thus the five splitting blade action is provided by the center or primary splitting blade, the two secondary splitting blades and the two tertiary splitting blades arranged symmetrically about the primary splitting blade. In the cutting action, therefore, the primary splitting blade initiates a first cutting action pealing or rolling the log into two parts which split outwardly and then are engaged by the secondary splitting blades which provide a cut of the two parts into further parts and then finally the tertiary splitting blades which effect a further cut.

In a further modification, the in feed of the logs onto the cradle 20 can be effected by a conventional chain arrangement. In this way the logs can simply be dumped onto the cradle and the chain arrangement moves the logs forward by frictional engagement with bottom surfaces of the logs. The logs are thus driven forwardly until they engage the micro switch whereupon the chain drive system is halted. The chain drive system has the advantage that it does not require reciprocation and acts on a log regardless of the length of the log or the position of the log on the chain.

In a yet further modification, a horizontal bar can be provided across the blade structure adjacent the top of the stroke so as to engage any logs or log portions which become jammed in the splitter and thus are carried upwardly with the splitter. The bar is positioned outwardly beyond the end of the blades and requires simply to engage the log portions at a position below the uppermost point in the stroke so that further upward movement of the blade pushes the log portions away from the blade and releases them from the jammed condition.

In a yet further modified arrangement the cutter table or cradle is provided with slots so that there is sufficient material in the cradle to support the logs as they are fed toward the blade and support the logs while the blade moves downwardly but the slots in the cradle allow the log portions when cut to fall through the cradle for collection on a suitable conveyor system. This arrangement provides support for the logs during the cutting action and avoids the possibility of a rear end of the log being lifted or twisted by the pressure of the blade beyond the end of the support of the log.

In a yet further modification, the secondary blades are formed with conventional double-sided bevel arrangements rather than the single side arrangement shown and the secondary blades are provided with wedges similar to the wedge 12 of the main splitting blade.

In a yet further modification, the secondary and/or tertiary splitting blades can be detachable from the main blade to accommodate different sizes of logs and to provide a different splitting action if required.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A log cutter-splitter for cutting and splitting logs, comprising:

support means for supporting a log in horizontal orientation including means for feeding the log along its length;

a wedge for splitting a log along its length having a wide top end and tapering to an apex at a bottom end;

a primary splitting blade arranged in a vertical plane and having a cutting edge at a bottom end for cutting the log along its length, the apex of the wedge and the cutting edge of the primary splitting blade lying in a common vertical plane;

a cutting blade arranged in a vertical plane and having a cutting edge at a bottom end for cutting across the width of the log;

mounting means for mounting the wedge, the primary splitting blade and the cutting blade above the support means such that the apex of the wedge lies at a height below the cutting edge of the primary splitting blade, and for mounting the primary splitting blade at a right angle to the cutting blade;

and driving means for driving the wedge, the primary splitting blade and the cutting blade downwardly into the log on the support means.

2. A log cutter-splitter according to claim 1 wherein the top end of the wedge is wider than the primary splitting blade.

3. A log cutter-splitter according to claim 1 wherein the support means include a forward edge and a rearward edge such that the log is moved in a direction from the rearward edge towards the forward edge and wherein the wedge, the splitting blade, and the cutting blade are located near the forward edge of the support means.

4. A log cutter-splitter according to claim 1 wherein the cutting edge of the primary splitting blade is V shaped in cross section.

5. A log cutter-splitter according to claim 1 wherein the cutting edge of the cutting blade is V shaped in cross section.

6. A log cutter-splitter according to claim 1 wherein the wedge and cutting blade are located at opposing ends of the primary splitting blade.

7. A log cutter-splitter according to claim 1 including a pair of secondary splitting blades each arranged in a vertical plane cutting the log along its length, being positioned for engaging log sections on a respective side of the primary splitting blade and substantially parallel thereto and each having a cutting edge at a bottom end.

8. A log cutter-splitter according to claim 7 wherein the secondary splitting blades are arranged such that the cutting edge of each of the secondary splitting blades lies at a height above the cutting edges of both the primary splitting blade and the cutting blade.

9. A log cutter-splitter according to claim 7 wherein the secondary splitting blades are arranged such that the cutting edge of each of the secondary splitting blades lies at a height above the wedge.

10. A log cutter-splitter according to claim 7 wherein the cutting edge of each of the secondary splitting blades is angled from a side surface thereof located furthest from the primary splitting blade downwards to a side surface thereof located nearest the primary splitting blade.

11. A log cutter-splitter according to claim 7 wherein the secondary splitting blades are attached to the cutting blade and extend therefrom to a position spaced from the wedge.

12. A log cutter-splitter for cutting and splitting logs, comprising:

support means for supporting a log in horizontal orientation including means for feeding of the log along its length;

a splitting member arranged in a vertical plane above the support means for engaging and splitting the log along its length;

a cutting blade arranged in a vertical plane at a right angle to the splitting member and having a cutting edge at a bottom end for cutting across the width of the log;

mounting means for mounting the splitting member on the cutting blade for movement therewith; and driving means for driving the splitting member and the cutting blade into the log on the support means;

the splitting member comprising a plate attached to the cutting blade and extending forwardly therefrom and a wedge attached to the plate at a position spaced from the cutting blade, the wedge having a wide top end and tapering generally to an apex at a bottom end with the apex having a height below that of a bottom edge of the plate.

13. A log cutter-splitter according to claim 12 wherein the plate has a cutting edge at the bottom edge.

14. A log cutter-splitter according to claim 13 wherein the apex of the wedge and the cutting edge of the plate are positioned in a common vertical plane with respect to each other.

15. A log cutter-splitter according to claim 12 wherein the apex of the wedge is arranged at a height lower than that of the cutting blade for engaging the log prior to the cutting blade.

16. A log cutter-splitter for cutting and splitting logs, comprising:

support means for supporting a log in horizontal orientation including means for feeding of the log along its length;

a cutting blade arranged in a vertical plane above the support means and having a cutting edge at a bottom end for cutting across the width of the log;

driving means for driving the cutting blade in a cutting movement into the log on the support means;

a primary splitting member including a wedge member having a wide top end and tapering generally to an apex at a bottom end;

a pair of secondary splitting blades each having a cutting edge at a bottom end and each arranged in a vertical plane at right angles to the cutting blade on a respective side of the primary splitting member, the cutting edge of each secondary splitting blade being arranged at a height above the wedge member;

and mounting means for mounting the primary splitting member, the secondary splitting blades and the cutting blade for common cutting movement.

17. A log cutter-splitter according to claim 16 wherein the wedge member is supported on a primary splitting blade at a right angle to the cutting blade so that the wedge member is spaced from the cutting blade and wherein the secondary splitting blades are attached to the cutting blade and extend therefrom to a position spaced from the wedge member.

* * * * *